US010095164B2

(12) United States Patent
Lee et al.

(10) Patent No.: US 10,095,164 B2
(45) Date of Patent: Oct. 9, 2018

(54) FIXING DEVICE AND IMAGE FORMING APPARATUS COMPRISING THE SAME

(71) Applicant: S-PRINTING SOLUTION CO., LTD., Suwon-si, Gyeonggi-do (KR)

(72) Inventors: Sun Hyung Lee, Yongin (KR); Sang Uk Jeon, Yongin (KR); Hyun Keun Park, Suwon (KR); Ju Hyeong Lee, Suwon (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 43 days.

(21) Appl. No.: 15/177,529

(22) Filed: Jun. 9, 2016

(65) Prior Publication Data

US 2016/0363891 A1 Dec. 15, 2016

(30) Foreign Application Priority Data

Jun. 11, 2015 (KR) ..... 10-2015-0082518

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 2215/2035
See application file for complete search history.

(56) References Cited

U.S. PATENT DOCUMENTS 7,627,279 B2 * 12/2009 Ardery ..... G03G 15/2064 219/216
2006/0233575 A1 * 10/2006 Uchida ..... G03G 15/2053 399/329
2013/0272762 A1 10/2013 Uekawa et al.

FOREIGN PATENT DOCUMENTS

JP 2008151923 A * 7/2008

OTHER PUBLICATIONS

Machine Translation of JP 2008-151923 A, obtained on Sep. 15, 2017.*

* cited by examiner

*Primary Examiner* — Gregory H Curran
(74) *Attorney, Agent, or Firm* — Staas & Halsey LLP

(57) ABSTRACT

A fixing device is provided which includes a fixing belt rotatably arranged, a fixing roller disposed to face the fixing belt and forming a fixing nip together with an outer surface of the fixing belt a guide unit configured to guide rotation of the fixing belt in the fixing belt; and a pair of support units configured to limit movement of the fixing belt in a width direction at both ends of the guide unit. The fixing device may have a structure of guiding rotation of the fixing belt and a structure of limiting movement thereof in width direction, which are separated from each other.

20 Claims, 16 Drawing Sheets

FIXING DEVICE AND IMAGE FORMING APPARATUS COMPRISING THE SAME

CROSS-REFERENCE TO RELATED APPLICATION(S)

This application claims the priority benefit of Korean Patent Application No. 10-2015-0082518, filed on Jun. 11, 2015 in the Korean Intellectual Property Office, the disclosure of which is incorporated herein by reference.

BACKGROUND

1. Field

Embodiments of the present disclosure relate to an image forming apparatus including a fixing device having an improved structure.

2. Description of the Related Art

An image forming apparatus forms an image on a printing medium in accordance with an input signal, and examples thereof include a printer, a photocopier, a facsimile, and a multifunction device combining functions thereof.

An electro-photographic image forming apparatus, one of the image forming apparatuses, includes a photosensitive unit including a photoreceptor, a charging unit disposed around the photosensitive unit and charging the photoreceptor to a predetermined potential, a developing unit including a developing roller, and an optical scanning unit. The optical scanning unit forms an electrostatic latent image on the surface of the photoreceptor by projecting light onto the photoreceptor charged to the predetermined potential by the charging unit. The developing unit forms a visible image by supplying a developing agent to the photoreceptor on which the electrostatic latent image is formed.

The visible image formed on the photoreceptor may be transferred to the printing medium directly or via an intermediate transfer body. The visible image transferred to the printing medium is fixed to the printing medium while passing through a fixing device.

A fixing device widely used in the art includes a fixing belt including a heating source and a fixing roller disposed in close contact with the heating roller and forming a fixing nip. When a printing medium to which a toner image is transferred enters between the fixing belt and the fixing roller, the toner image is fixed to the printing medium by heat received from the inside of the heating roller and pressure applied by the fixing nip.

Thus, it is important to regulate rotation of the fixing belt and movement of the fixing belt in a width direction. In order to regulate operation of the fixing belt, bushing members are provided at both ends of the fixing belt. The bushing members are adapted to guide rotation of the fixing belt and limit movement of the fixing belt in the width direction. However, meandering movement of the fixing belt may be caused since operation of the fixing belt is not stably supported by the bushing members due to improper mounting methods, tolerances between parts, gaps between components during assembly, size deviation of parts, and the like.

SUMMARY

Therefore, it is an aspect of the present disclosure to provide a fixing device configured to fix a visible image, which is transferred to a printing medium, to the printing medium and an image forming apparatus including the same.

It is another aspect of the present disclosure to provide a fixing device in which meandering movement of a fixing belt is prevented and an image forming apparatus including the same.

It is another aspect of the present disclosure to provide a fixing device in which abrasion of a fixing belt is prevented and an image forming apparatus including the same.

Additional aspects of the disclosure will be set forth in part in the description which follows and, in part, will be obvious from the description, or may be learned by practice of the disclosure.

In accordance with an aspect of the present invention, a fixing device includes: a fixing belt rotatably arranged; a fixing roller disposed to face the fixing belt and forming a fixing nip together with an outer surface of the fixing belt; a guide unit configured to guide rotation of the fixing belt in the fixing belt; and a pair of support units configured to limit movement of the fixing belt in a width direction at both ends of the guide unit. An operation of guiding rotation of the fixing belt performed by the guide unit may be independent from an operation of limiting movement of the fixing belt in the width direction by the pair of supporting units.

The pair of support units are detachably coupled to the guide unit.

The pair of support units move interrelatedly with the guide unit.

The guide unit includes: a unit body arranged in the fixing belt in a width direction; and a pair of rotation guide parts extending from the unit body and configured to guide rotation of the fixing belt at positions corresponding to both ends of the fixing belt in the width direction.

The pair of support units are disposed farther from a center of the width direction than the pair of rotation guide parts.

The unit body is disposed in the fixing belt to allow the fixing belt to pass between the unit body and the fixing roller, and the rotation guide part extends from the unit body along the inner surface of the fixing belt.

The pair of rotation guide parts comprise a plurality of rotation guide ribs formed in contact with the inner surface of the fixing belt.

The plurality of rotation guide ribs is arranged at intervals decreasing as the rotation guide ribs are closer to the ends of the fixing belt in the width direction.

The plurality of rotation guide ribs comprises first rotation guide ribs and second rotation guide ribs arranged closer to the width directional ends of the fixing belt than the first rotation guide ribs and having greater sizes than the first rotation guide ribs.

The plurality of rotation guide ribs comprises a rib contact part in contact with the inner surface of the fixing belt and a rib concave part more recessed than the rib contact part to be spaced apart from the inner surface of the fixing belt.

The guide unit further comprises a belt guide part arranged between the pair of rotation guide parts and supporting the inner surface of the fixing belt.

The fixing device further comprises a hear source disposed at the inner surface of the fixing belt adjacently to the fixing roller and configured to directly transfer heat to the fixing belt.

The fixing device further includes a bracket configured to limit movement of the support units. The support units are mounted to seating portions formed in the guide unit, and movement of the support units in the width direction is limited by the bracket.

The fixing device further comprises a pressing member configured to press the guide unit toward the fixing roller and formed in a width direction of the guide unit, and both ends of the pressing member are supported by the support units.

The unit body is disposed at one side of the inner surface of the fixing belt to allow the fixing belt to pass between the unit body and the fixing roller. The support unit includes support unit bodies arranged at both ends of the guide unit; and unit support parts protruding from the support unit bodies in the width direction of the fixing belt and correspond to the other side of the inner surface of the fixing belt.

In accordance with an aspect of the present invention, an image forming apparatus includes a fixing device configured to fix a visible image transferred to a printing medium to the printing medium. The fixing device comprises: a fixing belt rotatably arranged; a fixing roller disposed to face the fixing belt and forming a fixing nip together with an outer surface of the fixing belt; a pair of support units having a belt limiting surface configured to limit movement of the fixing belt in the width direction and arranged at both ends of the fixing belt; and a guide unit arranged provided in contact with the inner surface of the fixing belt to guide rotation of the fixing belt, comprising rotation guide parts disposed at inner positions than the pair of support units, and disposed in the fixing belt.

The rotation guide parts comprise a plurality of rotation guide ribs formed in contact with the inner surface of the fixing belt.

The plurality of rotation guide ribs comprises first rotation guide ribs and second rotation guide ribs arranged closer to the ends of the fixing belt in the width direction than the first rotation guide ribs and having greater sizes than the first rotation guide ribs.

The plurality of rotation guide ribs comprises a rib contact part in contact with the inner surface of the fixing belt and a rib concave part more recessed than the rib contact part to be spaced apart from the inner surface of the fixing belt.

In accordance with an aspect of the present invention, an image forming apparatus includes a fixing belt configured to rotate in a first direction and arranged in a second direction as a width direction; a fixing roller disposed to face the fixing belt and forming a fixing nip together with an outer surface of the fixing belt; a guide unit comprising a rotation guide part in contact with the inner surface of the fixing belt to guide rotation of the fixing belt in the first direction and arranged in the fixing belt; and a pair of support units having a belt limiting surface configured to limit movement of the fixing belt in the second direction and spaced apart from both ends of the fixing belt.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
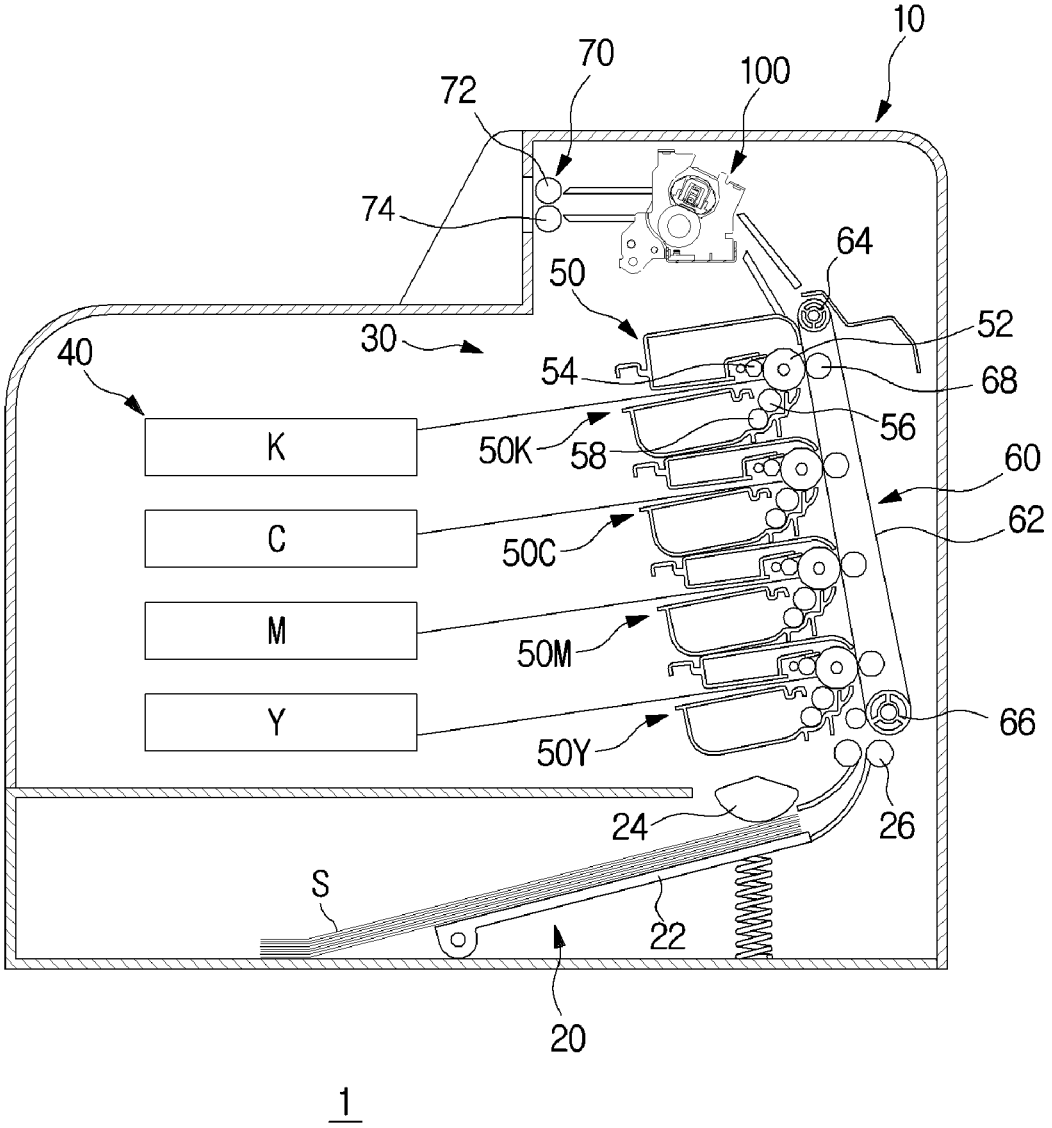
FIG. 1 is a view illustrating an image forming apparatus according to an embodiment of the present disclosure.

Reference will now be made in detail to the embodiments of the present disclosure, examples of which are illustrated in the accompanying drawings, wherein like reference numerals refer to like elements throughout.

The terms used in the present specification are used to describe particular embodiments, and are not intended to limit the present disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Hereinafter, exemplary embodiments of the present disclosure will be described in detail with reference to the accompanying drawings.

FIG. 1 is a view illustrating an image forming apparatus according to an embodiment of the present disclosure.

As illustrated in FIG. 1, an image forming apparatus 1 includes a main body 10, a printing medium feed device 20, a printing device 30, a fixing device 100, and a printing medium discharge device 70.

The main body 10 may define an external appearance of the image forming apparatus and supports various components installed therein. The main body 10 includes a cover (not shown) that opens and closes a part thereof, and a main body frame (not shown) that supports or fix various components in the main body 10.

The printing medium feed device 20 feeds a printing medium S into the printing device 30. The printing medium feed device 20 includes a tray 22 in which the printing media S are loaded and a pickup roller 24 to pick up the printing media loaded in the tray 22 one at a time. The printing medium picked up by the pickup roller 24 is transported toward the printing device 30 by a transport roller 26.

The printing device 30 may include an optical scanning device 40, a developing device 50, and a transfer device 60.

The optical scanning device 40 may include an optical system (not shown) to scan light corresponding to image information of yellow Y, magenta M, cyan C, and black K toward the developing device 50 in accordance with a print signal.

The developing device 50 forms a toner image in accordance with image information input from an external device such as a computer. The developing device 50 of the image forming apparatus 1 according to the present embodiment, which is a color image forming apparatus, includes developing devices including toners having different colors, for example, four developing devices 50Y, 50M, 50C, and 50K respectively including yellow Y, magenta M, cyan C, and black B toners.

Each of the developing devices 50Y, 50M, 50C, and 50K may include a photoreceptor 52 on which an electrostatic latent image is formed by the optical scanning device 40, a charging roller 54 configured to charge the photoreceptor 52, a developing roller 56 configured to supply a toner image to the electrostatic latent image formed on the photoreceptor 52, and a supply roller 58 configured to supply toner to the developing roller 56.

The transfer device 60 transfers the toner image formed on the photoreceptor 52 to the printing medium. The transfer device 60 may include a transfer belt 62 configured to circulate in contact with each photoreceptor 52, a transfer belt drive roller 64 configured to drive the transfer belt 62, a tension roller 66 configured to maintain tension of the transfer belt 62, and four transfer rollers 68 configured to transfer the toner image developed on the photoreceptor 52 to the printing medium.

The printing medium is attached to the transfer belt 62 and transported at the same speed as that of the transfer belt 62. In this case, a voltage of a polarity opposite to that applied to the toner attached to each photoreceptor 52 is applied to each transfer roller 68, and accordingly the toner image formed on the photoreceptor 52 is transferred to the printing medium.

The fixing device 100 fixes the toner image, which is transferred to the printing medium by the transfer device 60, to the printing medium.

The printing medium discharge device 70 discharges the printing medium out of the main body 10. The printing medium discharge device includes a discharge roller 72 and a pinch roller 74 installed to face the discharge roller 72.

Figure 2:
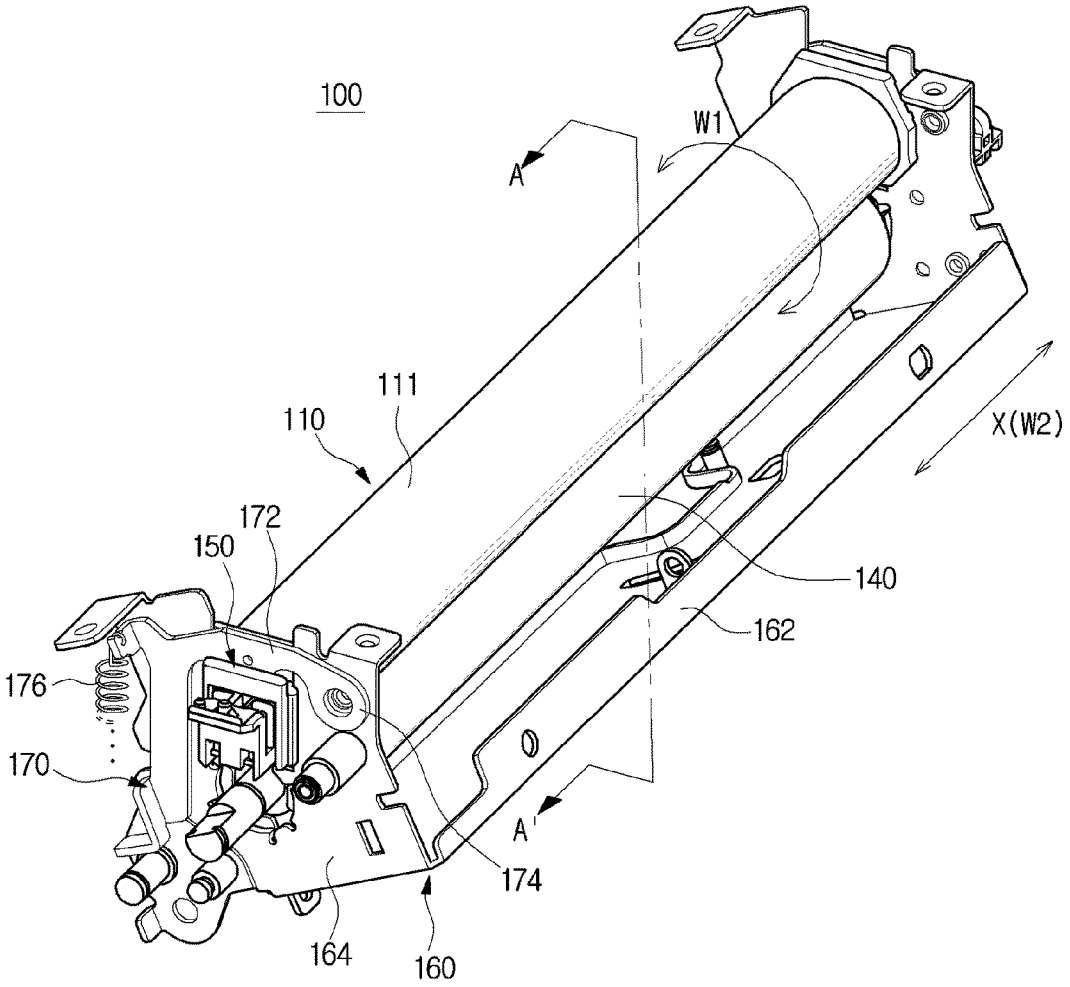
FIG. 2 is a perspective view illustrating the fixing device according to the embodiment.
Figure 3:
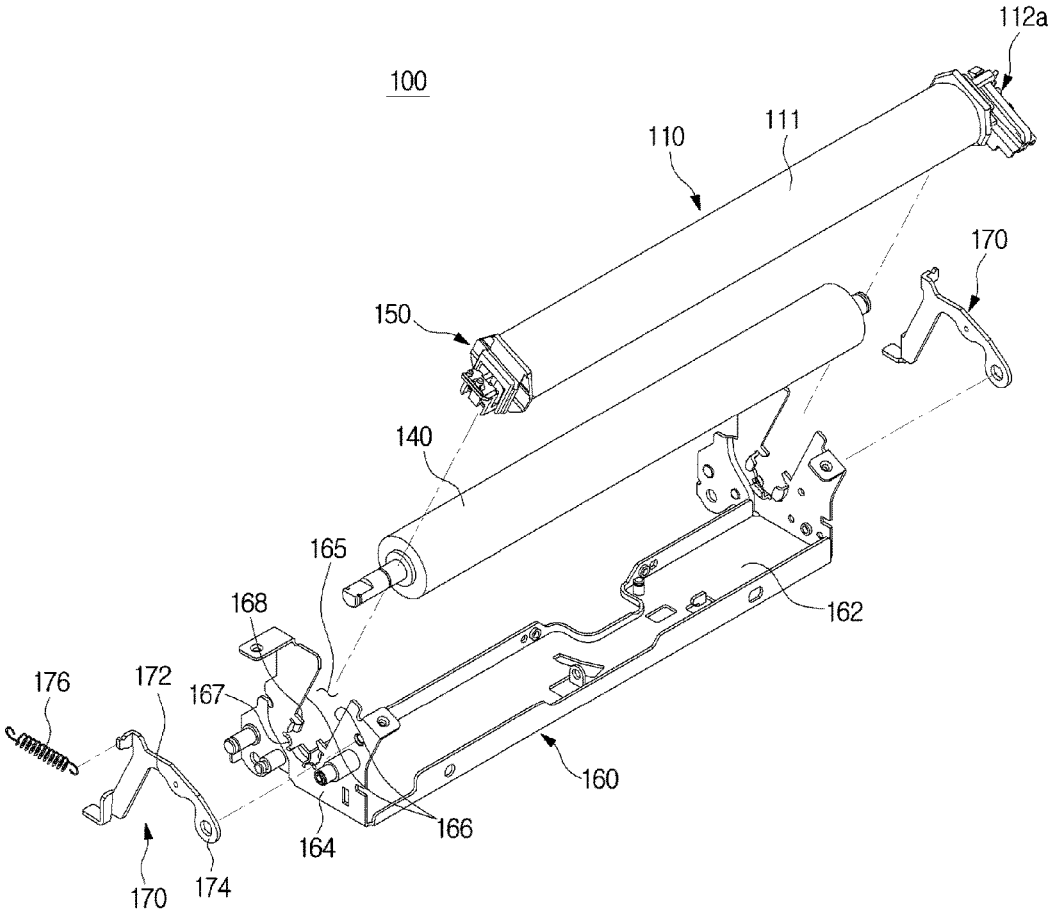
FIG. 3 is an exploded perspective view illustrating the fixing device according to the embodiment.
Figure 4:
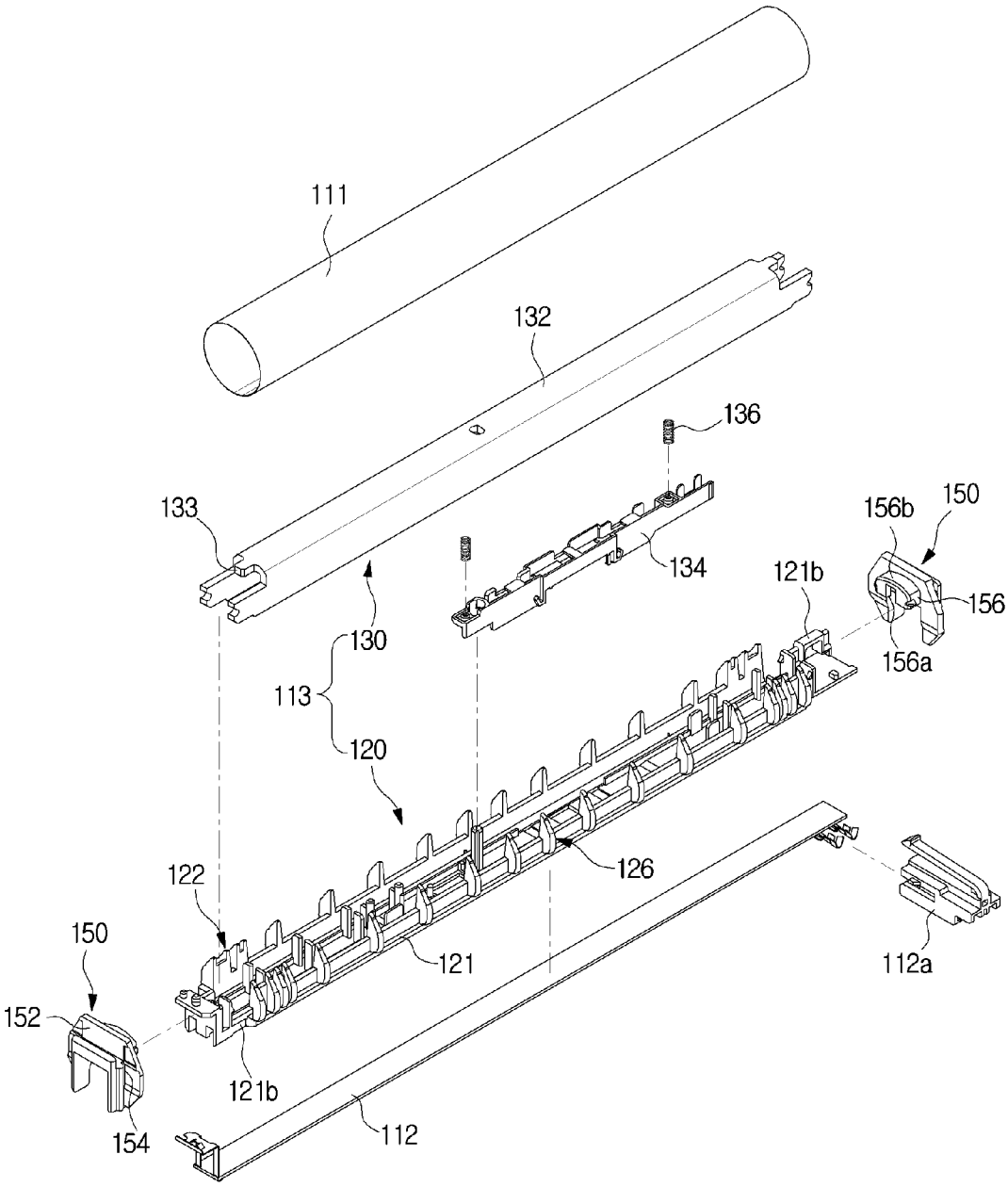
FIG. 4 is an exploded view illustrating a heating unit of the fixing device according to the embodiment.
Figure 5:
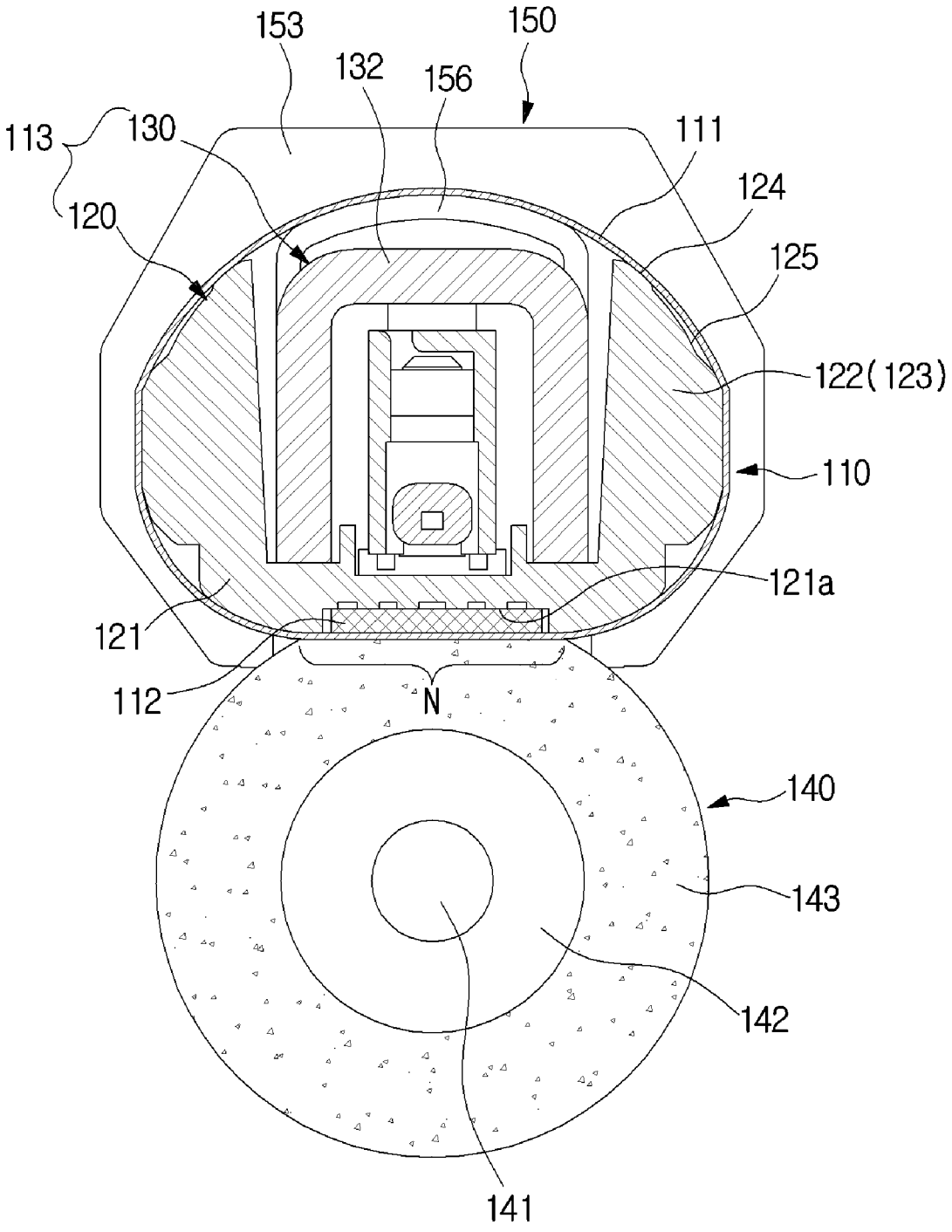
FIG. 5 is a cross-sectional view taken along line A-A' of FIG. 2.

FIG. 2 is a perspective view illustrating the fixing device according to the embodiment. FIG. 3 is an exploded perspective view illustrating the fixing device according to the embodiment. FIG. 4 is an exploded view illustrating a heating unit of the fixing device according to the embodiment. FIG. 5 is a cross-sectional view taken along line A-A' of FIG. 2.

Hereinafter, a width direction X of the printing medium S, a width direction X of a rotating member, and a width direction X of the fixing belt 111 are defined to indicate the same direction.

Referring to FIGS. 2 to 4, the fixing device 100 includes a rotating member and a heating member 110. Although the fixing device 100 in which heat is directly transferred heat from a heat source 112 to the fixing belt 111 is described according to an exemplary embodiment, the embodiment is not limited thereto. For example, a fixing device in which a heat source such as a halogen lamp is installed in the fixing belt 111 and the fixing belt 111 is heated by radiant heat from the heat source may also be used.

While the printing medium S to which the toner image is transferred passes between the rotating member and the heating member 110, the toner image may be fixed to the printing medium S by heat and pressure applied thereto.

The rotating member may be arranged to be in contact with the outer circumferential surface of the heating member 110 to form a fixing nip N (as illustrated, for example, in FIG. 5) with the heating member 110. The rotating member may include a fixing roller 140 configured to rotate by a power transmitted from a driving source (not shown).

The fixing roller 140 may be disposed to face the fixing belt 111 and form the fixing nip N together with the outer surface of the fixing belt 111. The fixing roller 140 includes a shaft 141 formed, for example, of a metallic material such as aluminum or steel and an elastic layer 143 elastically deformed to form the fixing nip N between the fixing roller 140 and the fixing belt 111. The elastic layer 143 may be formed, for example, of silicon rubber. The elastic layer 143 may have hardness, for example, of 50 to 80 on the ASKER-C scale, and the elastic layer 143 may have a thickness, for example, of 3 mm to 6 mm to apply high fixing pressure to the printing medium S in the fixing nip N. The elastic layer 143 may be heat resistant. A release layer (not shown) may be formed on the surface of the elastic layer 143 to prevent the printing medium S from being attached to the fixing roller 140. The release layer may include a heat-resistant resin coating layer or a heat-resistant rubber coating layer.

The heating member 110 may include the fixing belt 111, a nip-forming member 113, and the heat source 112.

The fixing belt 111 rotates engaging with the fixing roller 140 and forms the fixing nip N together with the fixing roller 140. The fixing belt 111 is heated by the heat source 112 and transfers heat to the printing medium S passing through the fixing nip N. The fixing belt 111 may rotate in a first direction W1 and may be arranged in a second direction W2 as a width direction X thereof. A rotation center of the fixing belt 111 may be parallel to a rotation center of the fixing roller 140. The fixing belt 111 may be an endless belt having a cylindrical shape. The fixing belt 111 may have a single-layered structure formed of a metal, a heat-resistant polymer, or the like. Alternatively, the fixing belt 111 may have a structure including a basic layer (not shown) formed of a metal such as aluminum or a heat-resistant polymer, an elastic layer (not shown) formed of silicon rubber or fluoro rubber and having high heat resistance, and a protective layer (not shown). A release layer formed of perfluoroalkoxy (PFA) or polytetrafluoro ethylene (PTFE) may be formed on the outer surface of the fixing belt 111.

The basic layer of the fixing belt 111 may be formed of a heat-resistant resin such as polyimide, polyamide, and polyimideamide or a metal such as SUS, nickel, and copper. The basic layer of the fixing belt 111 may have a thickness, for example, of 30 to 200 μm, preferably 50 to 100 μm.

The release layer (not shown) of the fixing belt 111 may be formed of a fluorine-based resin, PFA, PTFE, or FEP and may have a thickness of 10 to 30 μm.

The inner surface of the fixing belt 111 may be colored with black or coated to facilitate heat absorption.

The nip-forming member 113 forms the fixing nip N between the fixing belt 111 and the rotating member by applying pressure to the inner circumferential surface of the fixing belt 111. The nip-forming member 113 may be formed of a material having high strength such as stainless steel and carbon steel.

The nip-forming member 113 includes a guide unit 120 configured to guide the fixing belt 111 in contact with the inner surface of the fixing belt 111, and a pressing unit 130 disposed on the guide unit 120 and pressing and supporting the guide unit 120.

The pressing unit 130 may include a pressing support part 132, a guide pressing part 134, a pressing elastic member 136 disposed between the pressing support part 132 and the guide pressing part 134.

If the pressing unit 130 has a low rigidity, it may not uniformly press the fixing nip N due to considerable bending deformation thereof. Thus, the pressing support part 132 may have an arch-shaped cross-section to reduce the bending deformation.

The guide pressing part 134 may be arranged on the upper surface of a unit body 121 of the guide unit 120 and configured to press a the guide unit 120 toward the fixing roller 140 by receiving elasticity from the pressing elastic member 136, one end of which is supported by the pressing support part 132.

The guide unit 120 may be configured to guide rotation of the fixing belt 111 in the fixing belt 111. The guide unit 120 may be in contact with the inner surface of the fixing belt 111 to guide rotation of the fixing belt 111. The guide unit 120 forms the fixing nip N in contact with the inner surface of the fixing belt 111 and guides the fixing belt 111 such that the fixing belt 111 smoothly moves near the fixing nip N.

The guide unit 120 may include a rotation guide part 122 and a belt guide part 126. The rotation guide part 122 and the belt guide part 126 may extend from a unit body 121.

The fixing device 100 may include support units 150 provided at both ends of the nip-forming member 113 and supporting the nip-forming member 113.

The support units 150 may be provided at both ends of the guide unit 120 to limit movement of the fixing belt 111 in the width direction X. The support units 150 may be detachably coupled to the guide unit 120. The support units 150 may move interrelatedly with the guide unit 120.

Since the support units 150 are detachably coupled to the guide unit 120, the support units 150 and the guide unit 120 may operate independently. Particularly, the guide unit 120 that guides rotation of the fixing belt 111 and the support units 150 that limit movement of the fixing belt 111 in the width direction X are not restricted by each other. That is, an operation of guiding rotation of the fixing belt 111 by the guide unit 120 and an operation of restricting movement of the fixing belt 111 in the width direction X by a pair of support units 150 may be performed independently. Through this configuration, when elasticity is transferred to the support units 150 by a unit pressing part 170, rotation of the fixing belt 111 may not be influenced by a movement of the support units 150 even in an inclined state instead of a parallel movement thereof.

A pair of support units 150 may be provided at both ends of the fixing belt 111. According to an embodiment, a pair of support units 150 may be arranged to be spaced apart from each other by an interval greater than a length of the fixing belt 111 in the width direction X.

Although not shown in the drawings, the nip-forming member 113 may include a nip plate (not shown). The nip plate may be formed of a material having a high thermal conductivity and may be disposed between the guide unit 120 and the fixing belt 111 such that the fixing belt 111 and the fixing roller 140 efficiently form the fixing nip N.

The heat source 112 may be arranged to radiantly heat at least one portion of the inner circumferential surface of the fixing belt 111 directly.

The heat source 112 may include a heat generating layer and an insulating layer. A pair of insulating layers may be arranged on upper and lower surfaces of the heat generating layer. The heat generating layer may be formed of a ceramic material including $Al_2O_3$, AlN, and the like or a metallic material including an Ag—Pd alloy, and the like. A power unit 112*a* may be connected to the heat generating layer to generate heat by supplied electricity. The power unit 112*a* may be mounted to a power seating portion 121*b* provided at one end of the unit body 121 of the guide unit 120 which will be described later.

The fixing device 100 may include a bracket 160.

The bracket 160 may be provided such that the fixing device 100 is coupled to the main body of the image forming apparatus.

The bracket 160 may include a bracket body 162 coupled to the main body and unit support parts 164 disposed at both ends of the bracket body 162 to support the fixing belt 111 or the fixing roller 140 such that the fixing belt 111 or the fixing roller 140 is rotated.

The bracket 160 may include a unit insertion groove 165 at which the support unit 150 is arranged and a movement limiting part 166 coupled to a movement limiting groove 154 of the support unit 150. The unit insertion groove 165 may be formed to have a similar shape to the unit body 121. The unit insertion groove 165 and the movement limiting part 166 may be arranged in the unit support part 164.

A pair of movement limiting parts 166 may be provided to correspond to a pair of movement limiting grooves 154. A thickness of the movement limiting part 166 may correspond to a width of the movement limiting groove 154 such that the movement limiting part 166 is inserted into the movement limiting groove 154.

The bracket 160 may include a shaft guide part 167 and a partition protrusion 168.

The shaft guide part 167 may be disposed at the unit support part 164 such that the shaft 141 of the fixing roller 140 passes therein. The shaft guide part 167 may be formed in the unit support part 164 to prevent the shaft 141 from being dislocated from the unit support part 164.

The partition protrusion 168 may be formed between the shaft guide part 167 and the movement limiting part 166 to prevent the guide unit 120 or the support unit 150 from excessively moving toward the fixing roller 140. If the fixing belt 111 is in contact with the fixing roller 140 under a greater pressure than a sufficient pressure to form the fixing nip N, the fixing nip N may be deformed or the fixing belt 111 and the fixing roller 140 may be deformed due to excessive frictional force. Thus, the partition protrusion 168 may prevent excessive close contact therebetween.

The fixing device 100 may include the unit pressing part 170 configured to allow the support unit 150 to be in close contact with the guide unit 120. The unit pressing part 170 presses the support unit 150 such that the guide unit 120 is seated on the support unit 150.

The unit pressing part 170 may include a pressing body 172 to press the support unit 150, a unit rotation part 174 disposed at one end of the pressing body 172 to be rotatable about the unit support part 164 of the bracket 160, and a unit elastic member 176. Since one end of the unit elastic member 176 is fixed to the bracket 160, and the other end is fixed to the pressing body 172, the pressing body 172 may have elasticity in a direction where the pressing body 172 presses the support unit 150.

However, the shape of the unit pressing part 170 is not limited. Alternatively, for example, one end of the unit elastic member 176 may be fixed to the bracket 160, and the other end may be fixed to the support unit 150. According to an embodiment, elasticity may be directly applied to the support unit 150 by the unit elastic member 176.

Figure 6:
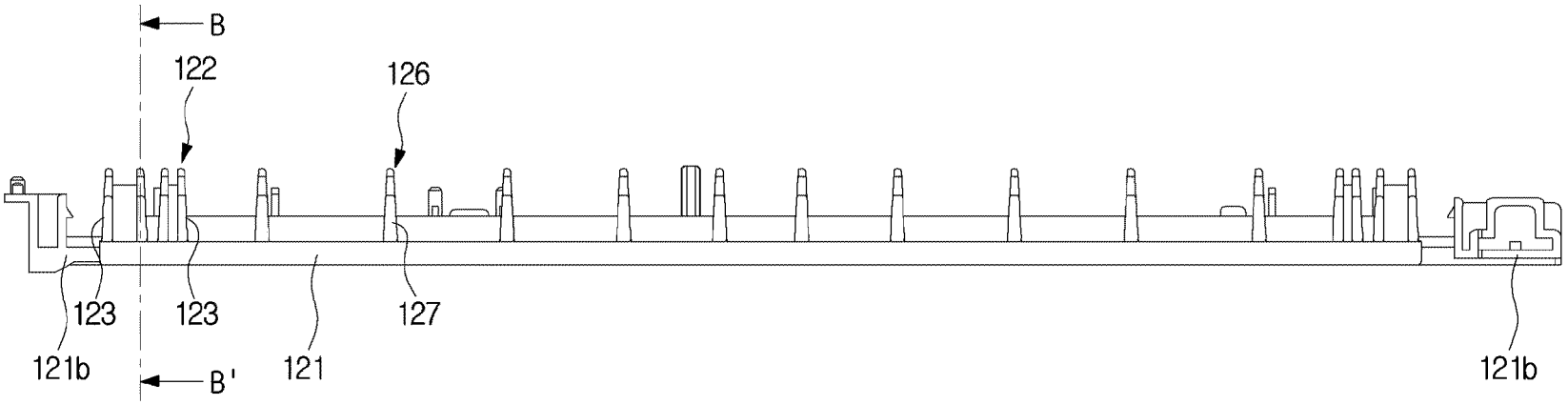
FIG. 6 is a view illustrating the guide unit of the fixing device according to the embodiment.
Figure 7:
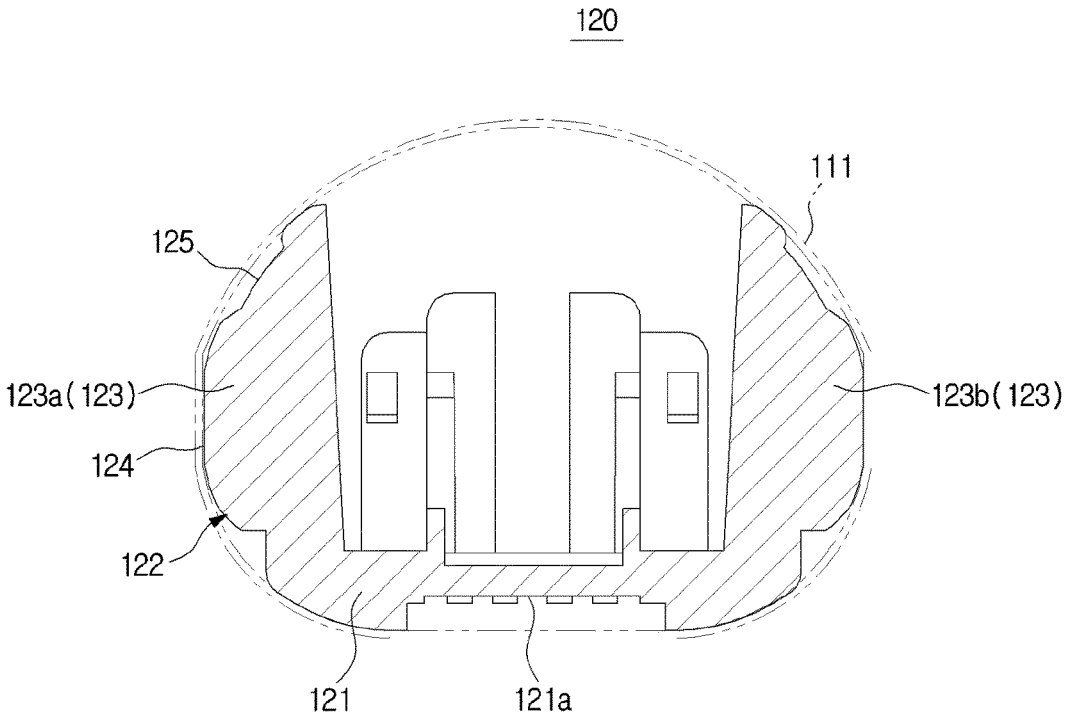
FIG. 7 is a cross-sectional view taken along line B-B' of FIG. 6.

FIG. 6 is a view illustrating the guide unit of the fixing device according to the embodiment. FIG. 7 is a cross-sectional view taken along line B-B' of FIG. 6.

The guide unit 120 may be provided in the fixing belt 111 to guide rotation of the fixing belt 111. The guide unit 120 may be in contact with the inner surface of the fixing belt 111 to guide rotation of the fixing belt 111.

The heat source 112 may be arranged at a lower portion of the guide unit 120. The guide unit 120 may include the unit body 121 disposed in the fixing belt 111 in the width direction X and a heat source insertion groove 121*a*. The heat source insertion groove 121*a* may be formed to be recessed such that the heat source 112 is arranged at a lower portion of the guide unit 120. Particularly, the heat source insertion groove 121*a* may be formed at the unit body 121 to be recessed in the width direction X. The heat source 112 is inserted into the heat source insertion groove 121*a* to be arranged to face the fixing belt 111. Since the heat source 112 is arranged at the lower portion of the unit body 121 to directly transfer heat to the fixing belt 111, heat transfer efficiency may be increased by reducing heat loss.

The guide unit 120 may include the rotation guide part 122 and the belt guide part 126.

The rotation guide part 122 may extend from the unit body 121. The rotation guide part 122 may be formed integrally with the unit body 121.

The rotation guide part 122 may be provided at both ends of the fixing belt 111 in the width direction X to guide rotation of the fixing belt 111. The unit body 121 may be disposed in the fixing belt 111 such that the fixing belt 111 passes between the fixing roller 140 and the unit body 121. The rotation guide part 122 may extend from the unit body 121 along the inner surface of the fixing belt 111. The rotation guide part 122 may be formed to be in contact with the unit body 121 and the inner surface of the fixing belt 111.

At least one rotation guide part 122 may be disposed in the unit body 121. According to an exemplary embodiment, a pair of rotation guide parts 122 extend from the unit body 121 at positions corresponding to both ends of the fixing belt 111 in the width direction X.

The rotation guide part 122 may include at least one rotation guide rib 123 formed along the inner surface of the fixing belt 111 in contact therewith. According to an exemplary embodiment, a plurality of rotation guide parts 122 may be arranged to be spaced apart from each other. One side of the rotation guide rib 123 supports the inner surface of the fixing belt 111 to prevent distortion or deformation of the fixing belt 111 during a rotating process. The rotation guide ribs 123 may extend from both sides of the unit body 121 along the inner surface of the fixing belt 111 as illustrated in FIG. 7. At least one rotation guide rib 123 includes a pair of rotation guide ribs 123*a* and 123*b* extending from both sides of the unit body 121. Since a pair of rotation guide ribs 123*a* and 123*b* are spaced apart from each other as illustrated in FIG. 7, the pressing unit 130 may be arranged therebetween.

The rotation guide rib 123 may have a rib contact part 124 in contact with the inner surface of the fixing belt 111 and a rib concave part 125 more recessed than the rib contact part 124 to be spaced apart from the inner surface of the fixing belt 111. The rib contact part 124 in contact with the inner surface of the fixing belt 111 supports rotation of the fixing belt 111 to prevent the fixing belt 111 from being distorted or deformed during the rotating process.

The rib concave part 125 may be more recessed than the rib contact part 124 and provided to minimize a contact area between the rib contact part 124 and the inner surface of the fixing belt 111. Through this configuration, spreading of heat, which is transferred from the heat source 112, through the rib contact part 124 may be minimized in the fixing belt 111. Accordingly, heat may be uniformly spread in the width direction X of the fixing belt 111, and thus fixing may be uniformly performed in the width direction X.

The guide unit 120 may include the belt guide part 126. The belt guide part 126 is provided to guide rotation of the fixing belt 111 together with the rotation guide part 122.

The belt guide part 126 may be formed between a pair of rotation guide parts 122. The belt guide part 126 may include at least one belt guide rib 127 formed in contact with the inner surface of the fixing belt 111. A plurality of belt guide ribs 127 may extend from the unit body 121 to be spaced apart from each other. The shape of the belt guide rib 127 may be the same as the rotation guide rib 123.

The belt guide part 126 may include a rib contact part 124 in contact with the inner surface of the fixing belt 111 and a rib concave part 125 more recessed than the rib contact part 124. Since the rib contact part 124 and the rib concave part 125 of the belt guide part 126 have the same shape and functions as the rib contact part 124 and the rib concave part 125 of the rotation guide part 122, descriptions thereof will not be given herein.

The guide unit 120 may have seating portions 121*b*. The seating portions 121*b* may be provided at both ends of the unit body 121 such that the support units 150 are mounted to the guide unit 120. According to an exemplary embodiment, the seating portion 121*b* may be disposed at a position closer to the end of the unit body 121 than the rotation guide part 122. As the support units 150 are mounted to the seating portions 121*b* of the guide unit 120, movement of the guide unit 120 in the width direction X may be limited by the bracket 160.

Figure 8:
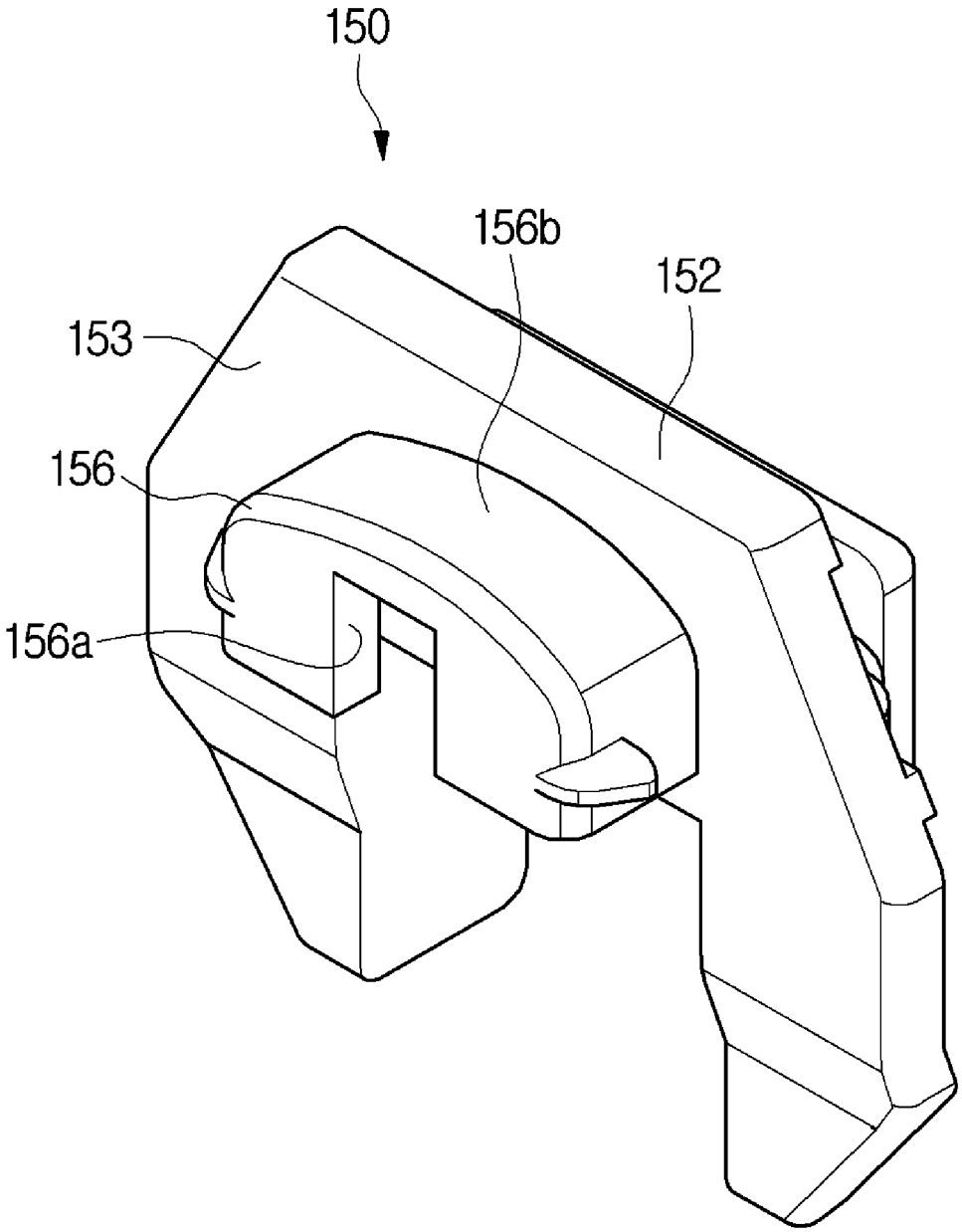
FIG. 8 is a view illustrating the support unit of the fixing device according to the embodiment.

FIG. 8 is a view illustrating the support unit of the fixing device according to an embodiment.

The support units 150 may be provided at both ends of the guide unit 120 to limit movement of the fixing belt 111 in the width direction X. The support units 150 may be detachably coupled to the guide unit 120.

Figure 10:
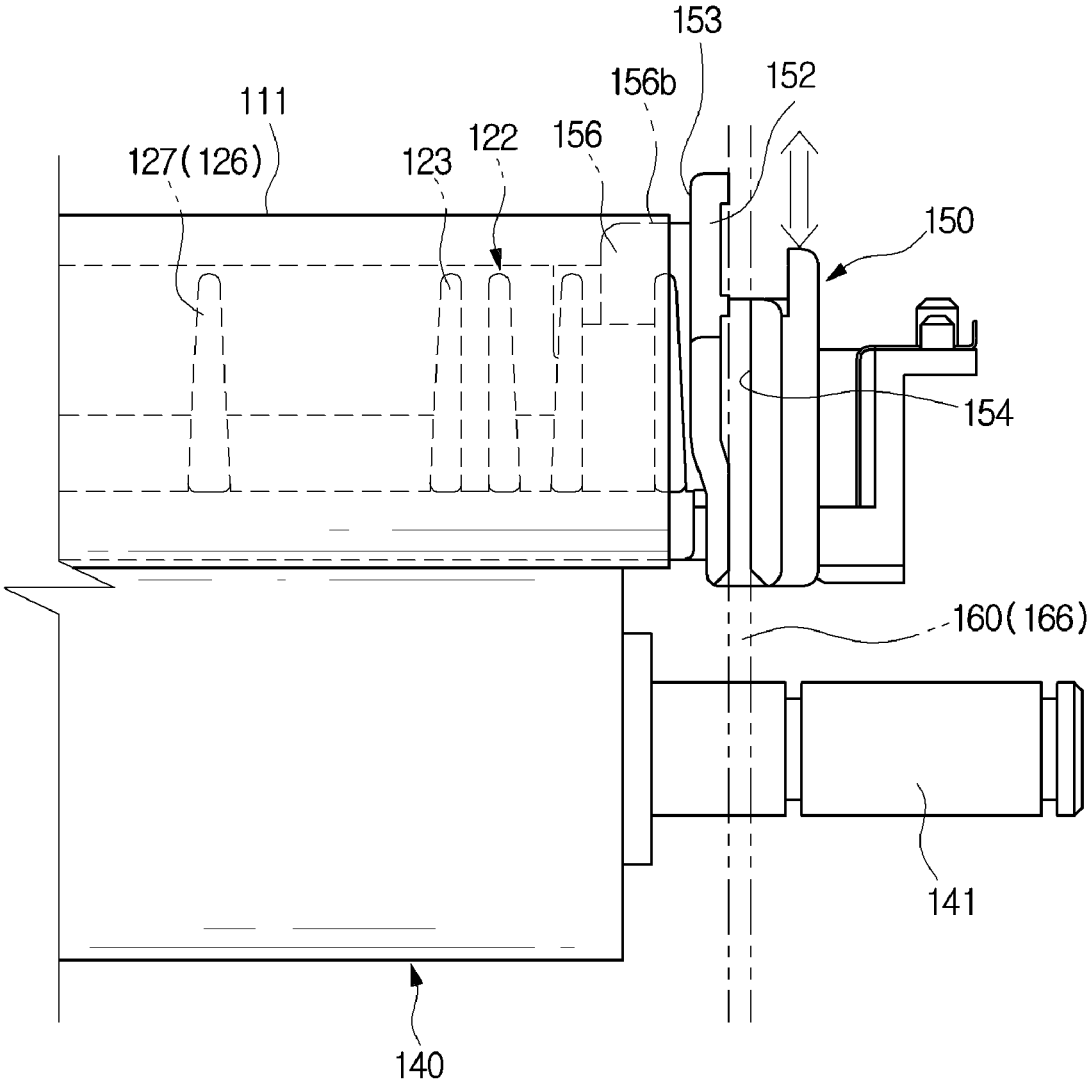
FIGS. 10 and 11 are views illustrating structures that guide the fixing belt in the fixing device according to the embodiment.

The support unit 150 may include a support unit body 152 and a movement limiting groove 154 (see, for example, FIG. 10).

The support unit body 152 may be formed to surround one side of the guide unit 120. The support unit body 152 may have a belt limiting surface 153 provided at one side surface thereof and limiting movement of the fixing belt 111. The belt limiting surface 153 may be formed in the support unit body 152 to face the fixing belt 111 and limits movement of the fixing belt 111 in the width direction X. The belt limiting surface 153 may be provided in contact with ends of the fixing belt 111, thereby limiting movement of the fixing belt 111 in the width direction X.

The movement limiting groove 154 may be arranged at the support unit body 152 to limit a moving direction of the support unit 150. According to an exemplary embodiment, the movement limiting groove 154 may be formed at the support unit body 152 to be recessed and extend in a direction where the fixing belt 111 is arranged with respect to the fixing roller 140.

A pair of movement limiting grooves 154 may be disposed at both sides of the support unit body 152. The movement limiting part 166 of the bracket 160, which will be described later, is arranged at the movement limiting groove 154, and the support unit 150 may slidably move with respect to the bracket 160. That is, the bracket 160 limits movement of the support unit 150 in a direction where a heating roller moves to be in close contact with the fixing roller 140 or spaced apart therefrom.

The support unit 150 may include a belt support part 156. The belt support part 156 may protrude from the unit body 121 in the width direction X of the fixing belt 111.

The belt support parts 156 may be provided to support both ends of the pressing unit 130. Support protrusions 133 are formed at both ends of the pressing unit 130 to be supported by the belt support parts 156, and the belt support parts 156 may have protrusion grooves 156*a* corresponding to the support protrusions 133 into which the support protrusions 133 are inserted.

The belt support part 156 may have a belt contact surface 156*b* formed in a curved shape at one surface thereof to correspond to the shape of the inner surface of the fixing belt 111. The unit body 121 may be disposed at one side of the inner surface of the fixing belt 111, and the belt contact surfaces 156*b* are provided at the other side of the inner surface at both ends of the fixing belt 111. The guide unit 120 and the belt contact surfaces 156*b* may prevent distortion and deformation of the fixing belt 111 while rotating.

An exemplary operation of guiding rotation of the fixing belt 111 by the support unit 150 and the guide unit 120 is described.

Figure 9:
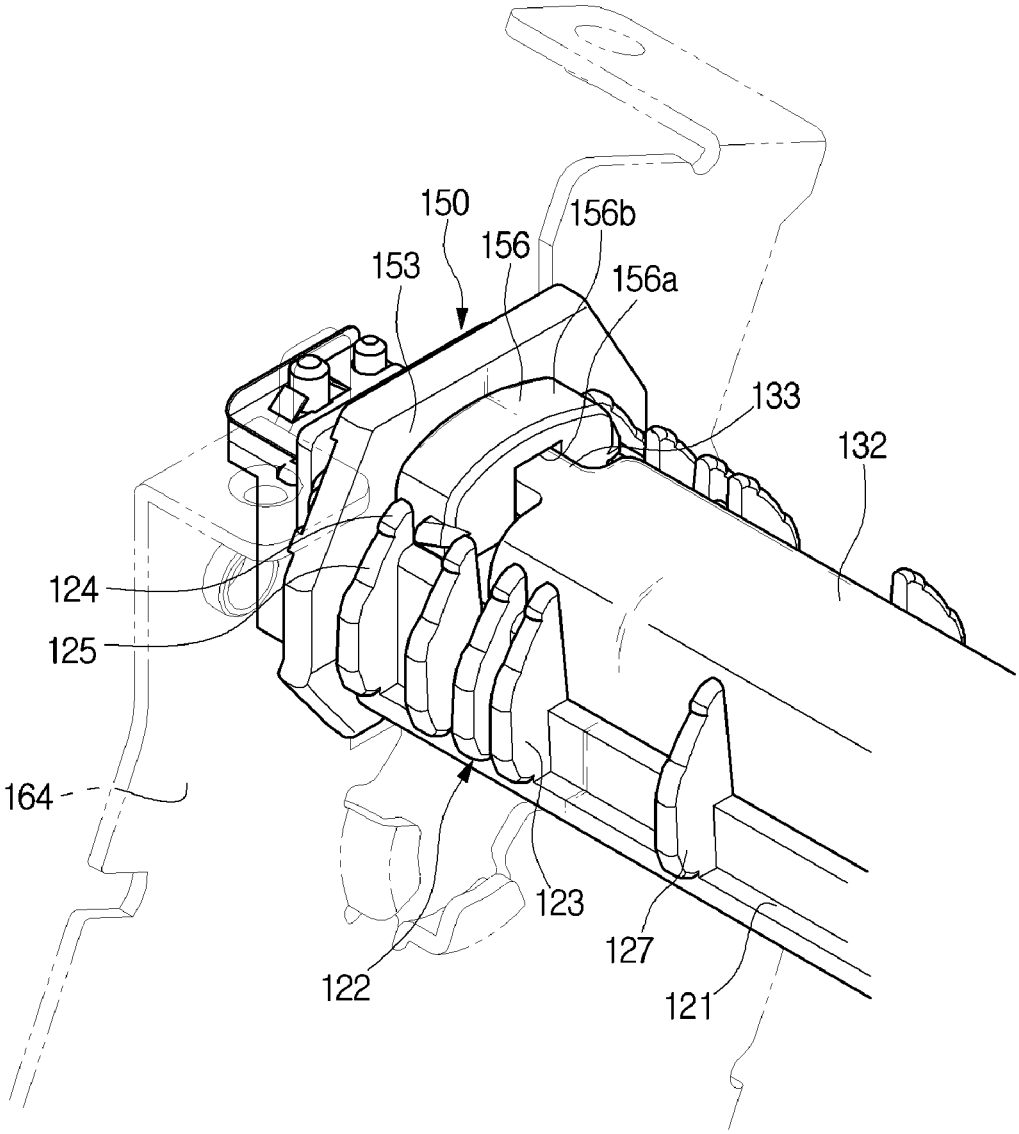
FIG. 9 is a view illustrating the fixing device according to the embodiment.
Figure 11:
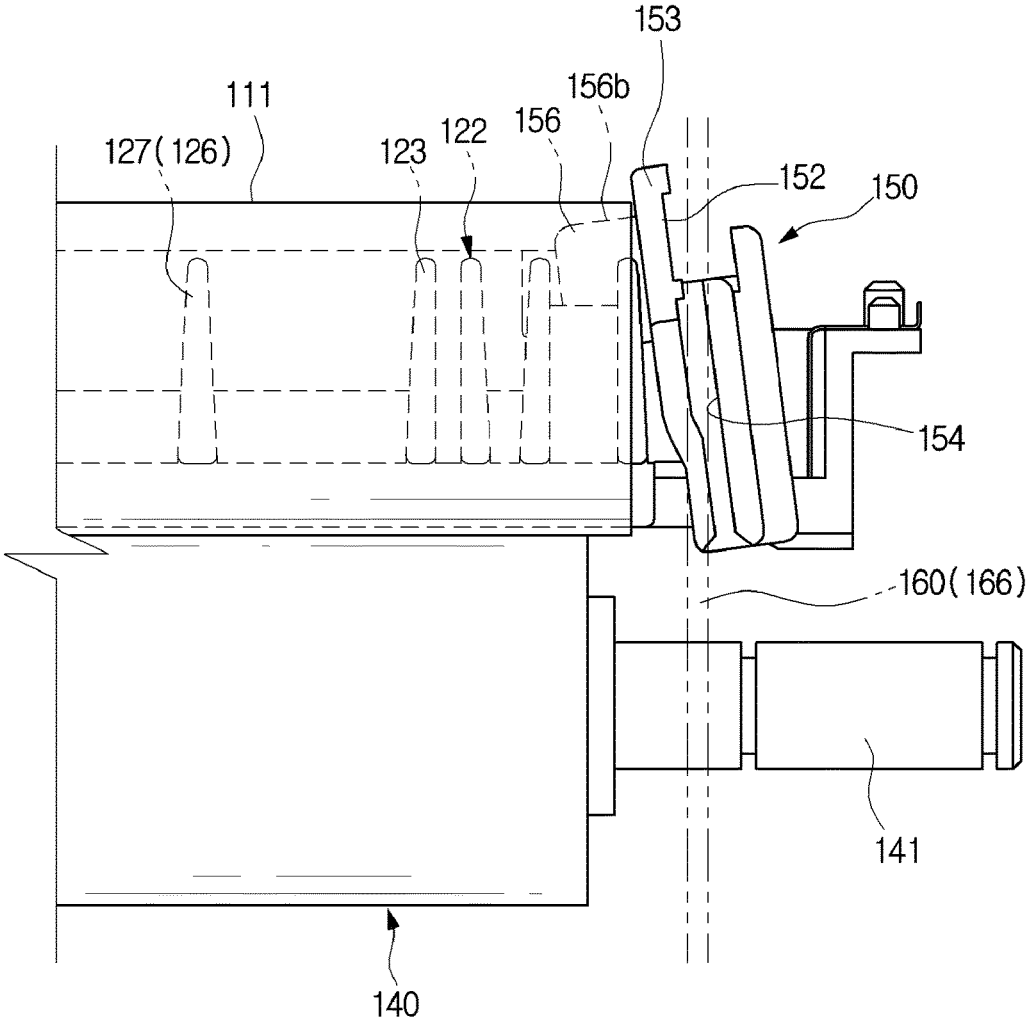

FIG. 9 is a view illustrating the fixing device according to an embodiment. FIGS. 10 and 11 are views illustrating structures that guide the fixing belt in the fixing device according to an embodiment.

When the fixing roller 140 rotates by power transmitted from a drive source, the fixing belt 111 may rotate engaging with the fixing roller 140.

While the fixing belt 111 rotates, the inner surface of the fixing belt 111 may be supported by the rotation guide part 122 and the belt guide part 126 of the guide unit 120.

If a movement such as a meandering movement of the fixing belt 111 occurs, the movement of the fixing belt 111 in the width direction X may be limited by the belt limiting surfaces 153 of the support units 150 disposed at the guide unit 120.

By separating the guide unit 120 that regulates rotation of the fixing belt 111 from the support units 150 that regulate movement of the fixing belt 111 in the width direction X, dislocation of the support unit 150 with respect to the guide unit 120 does not affect the rotation of the fixing belt 111 as illustrated in FIG. 11.

An image forming apparatus according to another exemplary embodiment of the present disclosure is described.

In the descriptions with regard to the following embodiment, similar descriptions presented above will not be repeated.

Figure 12:
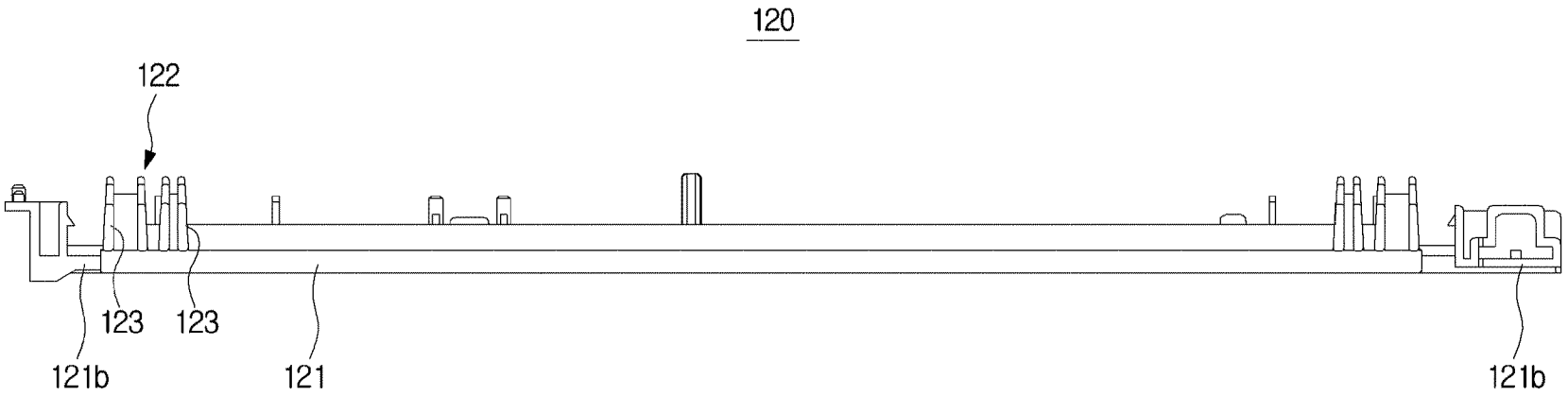
FIG. 12 is a view illustrating a guide unit of a fixing device according to another embodiment of the present disclosure.

FIG. 12 is a view illustrating a guide unit of a fixing device according to another embodiment of the present disclosure.

The guide unit 120 may be provided in the fixing belt 111 to guide rotation of the fixing belt 111. The guide unit 120 may be in contact with the inner surface of the fixing belt 111 to guide rotation of the fixing belt 111.

The guide unit 120 may include the rotation guide part 122. That is, although the belt guide part 126 is used according to the embodiment previously described, the guide unit 120 may not include the belt guide part 126 according to the present exemplary embodiment.

The rotation guide part 122 may extend from the unit body 121 to guide rotation of the fixing belt 111 at both ends of the fixing belt 111 in the width direction X.

An image forming apparatus according to another embodiment of the present disclosure is described.

In the descriptions with regard to the following embodiment, similar descriptions presented above are not repeated.

Figure 13:
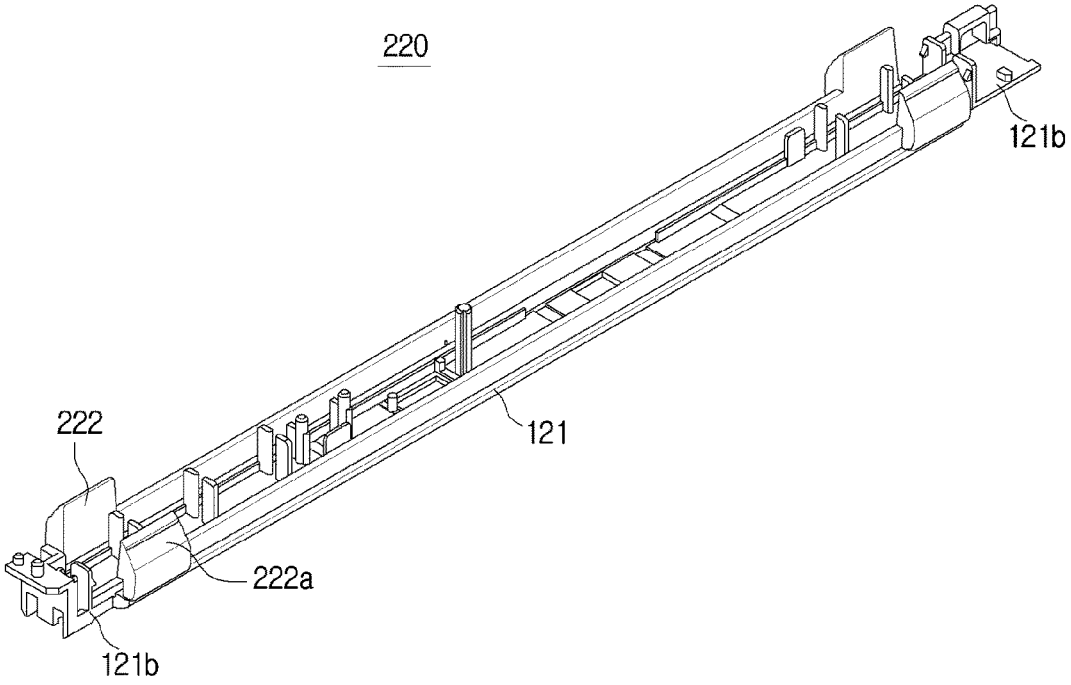
FIG. 13 is a view illustrating a guide unit of a fixing device according to another embodiment of the present disclosure.

FIG. 13 is a view illustrating a guide unit of a fixing device according to another embodiment of the present disclosure.

A guide unit 220 may be provided in the fixing belt 111 to guide rotation of the fixing belt 111. The guide unit 220 may be in contact with the inner surface of the fixing belt 111 to guide rotation of the fixing belt 111.

The guide unit 220 may include a rotation guide part 222.

The rotation guide part 222 may extend from the unit body 121.

The rotation guide part 222 may be arranged to guide rotation of the fixing belt 111 at both ends of the fixing belt 111 in the width direction X. The unit body 121 may be arranged in the fixing belt 111 such that the fixing belt 111 passes between the fixing roller 140 and the unit body 121, and the rotation guide part 222 may be formed to extend from the unit body 121 along the inner surface of the fixing belt 111. The rotation guide part 222 may extend from the unit body 121 to be in contact with the fixing belt 111.

At least one rotation guide part 222 may be disposed in the unit body 121. According to an exemplary embodiment, a pair of rotation guide parts 222 may be disposed at both ends of the unit body 121.

The rotation guide part 222 may be formed in contact with the inner surface of the fixing belt 111. The rotation guide part 222 may guide certain sections of both ends of the fixing belt 111. According to an exemplary embodiment, the rotation guide part 222 have contact surfaces 222*a* that are in contact with the certain sections of the inner surfaces of both ends of the fixing belt 111, and rotation of the fixing belt 111 may be guided by the contact surfaces 222*a*.

The contact surfaces 222*a* support rotation of the fixing belt 111 to prevent the fixing belt 111 from distorted or deformed while rotating in contact with the inner surface of the fixing belt 111.

An image forming apparatus according to another embodiment of the present disclosure is described.

In the descriptions with regard to the following embodiment, similar descriptions are not repeated.

Figure 14:
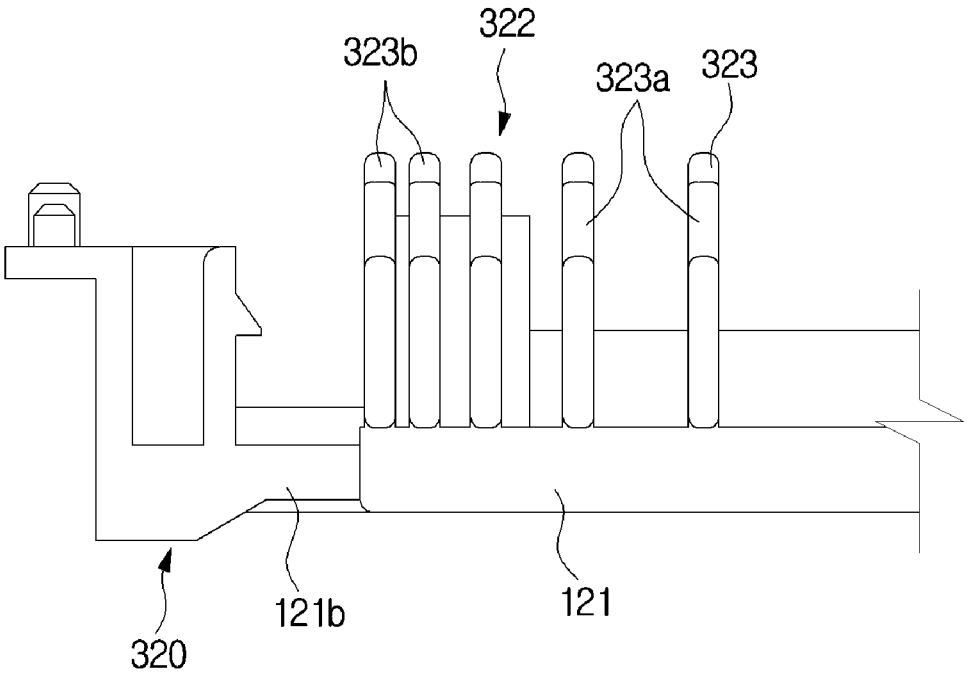
FIG. 14 is a view illustrating a guide unit of a fixing device according to another embodiment of the present disclosure.

FIG. 14 is a view illustrating a guide unit of a fixing device according to another embodiment of the present disclosure.

A guide unit 320 may be provided in the fixing belt 111 to guide rotation of the fixing belt 111. The guide unit 320 may be in contact with the inner surface of the fixing belt 111 to guide rotation of the fixing belt 111.

The guide unit 320 may include a rotation guide part 322.

The rotation guide part 322 may include a plurality of rotation guide ribs 323 formed along the inner surface of the fixing belt 111 in contact therewith.

The plurality of rotation guide ribs 323 may be arranged in the unit body 121 such that intervals therebetween decreases as the rotation guide ribs 323 are closer to the ends of the unit body 121. According to exemplary embodiment, a plurality of rotation guide ribs 323*a* disposed closer to the ends of the guide unit 320 are spaced apart from each other at smaller intervals than a plurality of rotation guide ribs

323*b* disposed closer to the center of the guide unit 320 in the width direction X of the guide unit 320.

With this configuration, if the fixing belt 111 meanders, frictional force generated by contact with the rotation guide ribs 323 may increase as the rotation guide ribs 323 are closer to the ends of the guide unit 320. As the frictional force increases at both ends of the fixing belt 111 by the plurality of rotation guide ribs 323, the meandering fixing belt 111 returns to the original position. Thus, the fixing belt 111 normally rotates.

An image forming apparatus according to another embodiment of the present disclosure is described.

In the descriptions with regard to the present embodiment, similar descriptions presented above are not repeated.

Figure 15:
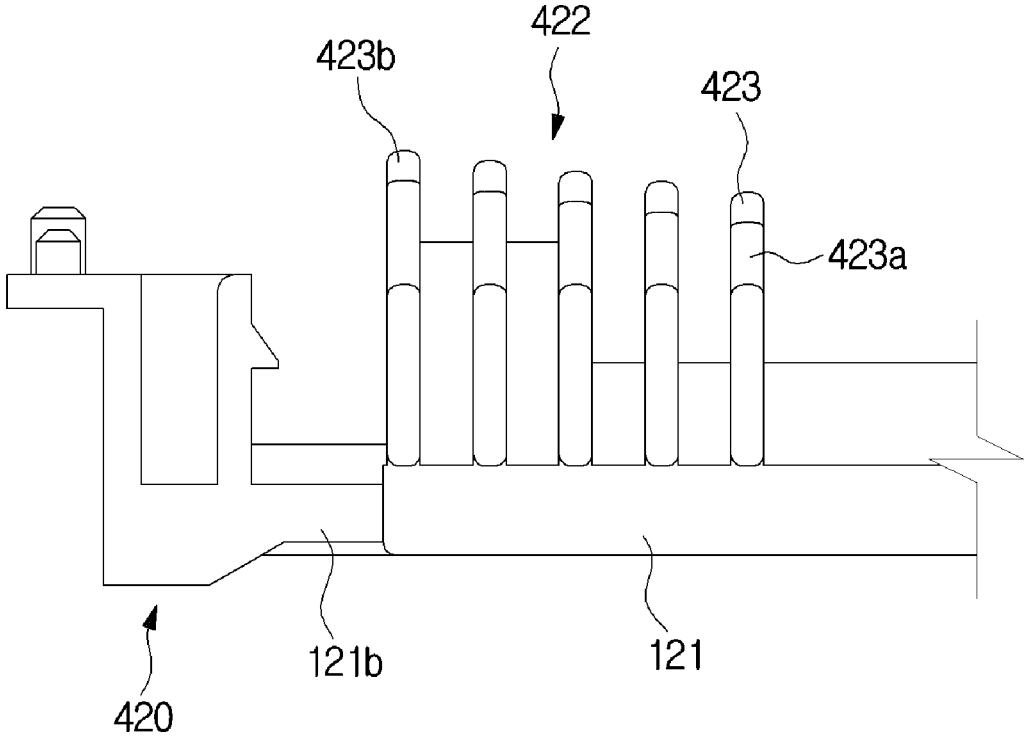
FIGS. 15 and 16 are views illustrating a guide unit of a fixing device according to another embodiment of the present disclosure.
Figure 16:
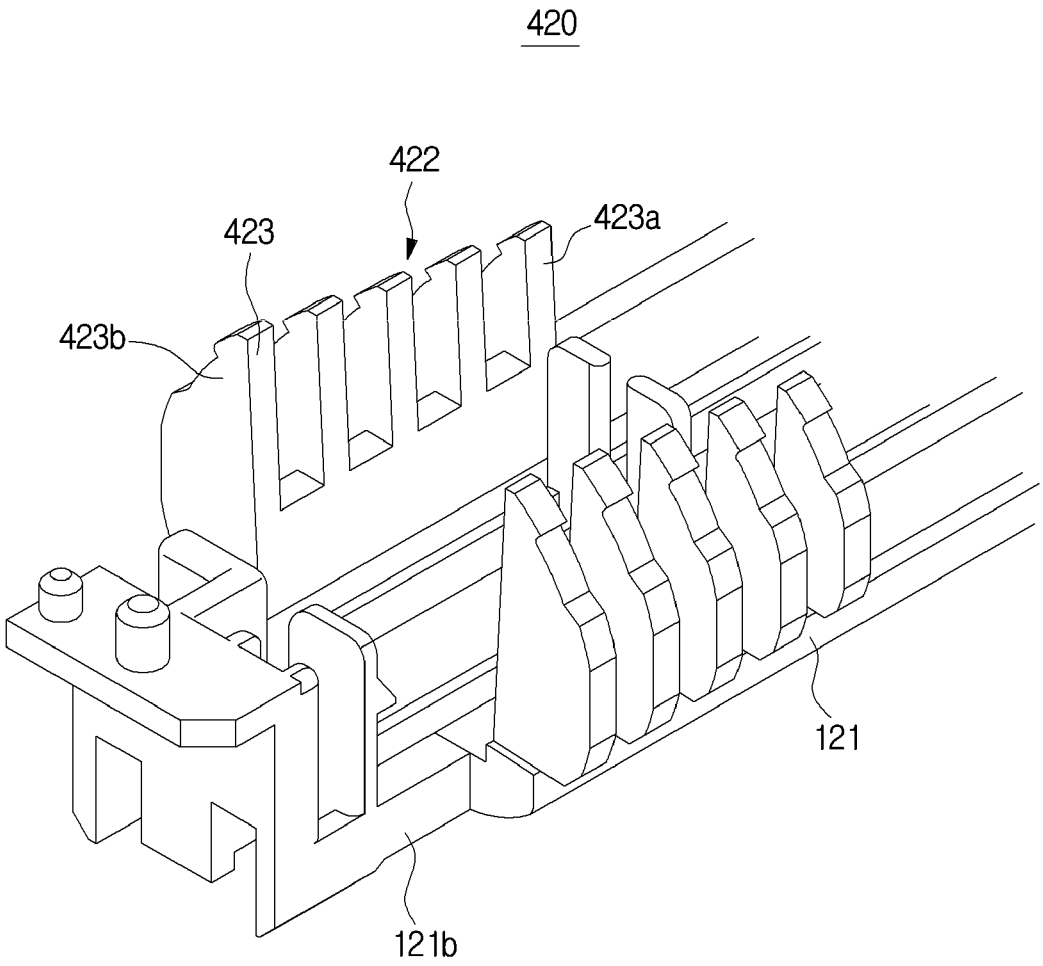

FIGS. 15 and 16 are views illustrating a guide unit of a fixing device according to another embodiment of the present disclosure.

A guide unit 420 may be provided to guide rotation of the fixing belt 111 in the fixing belt 111. The guide unit 420 may be in contact with the inner surface of the fixing belt 111 to guide rotation of the fixing belt 111.

The guide unit 420 may include a rotation guide part 422.

The rotation guide part 422 may include a plurality of rotation guide ribs 423 formed along the inner surface of the fixing belt 111 in contact therewith.

The plurality of rotation guide ribs 423 may be arranged such that the rotation guide ribs 423 disposed closer to the ends of the guide unit 420 have greater sizes than the rotation guide ribs 423 disposed closer to the center of the guide unit 420 in the width direction X of the guide unit 420.

According to an exemplary embodiment, the plurality of rotation guide ribs 423 may include first rotation guide ribs 423*a* and second rotation guide ribs 423*b* disposed closer to the ends of the fixing belt 111 in the width direction X and greater than the first rotation guide ribs 423*a*.

With this configuration, if the fixing belt 111 meanders, frictional force generated by contact with the rotation guide ribs 423 may increase as the rotation guide ribs 423 are closer to the ends of the guide unit 420. As the frictional force increases at both ends of the fixing belt 111 by the plurality of rotation guide ribs 423, the meandering fixing belt 111 returns to the original position. Thus, the fixing belt 111 normally rotates.

As is apparent from the above description, the image forming apparatus according to the present disclosure may have a structure of guiding rotation of the fixing belt and a structure of limiting movement thereof in width direction, which are separated from each other. Thus, malfunctioning of the fixing device caused by external factors may be prevented.

In addition, the visible image transferred to the printing medium may be fixed to the printing medium by preventing meandering of the fixing belt.

Furthermore, a lifespan of the fixing device may be increased by preventing abrasion of the fixing belt.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A fixing device comprising:

a fixing belt rotatably arranged in the fixing device;

a fixing roller disposed to have a surface face an outer surface of the fixing belt and forming a fixing nip together with the outer surface of the fixing belt;

a guide unit to guide a rotation of the fixing belt and disposed within the fixing belt;

a pair of support units to limit a movement of the fixing belt in a width direction and each of the pair of support units located at a respective end of the guide unit; and a pressing member, having an arch-shaped cross-section, to press the guide unit toward the fixing roller and being longitudinally elongated from a first support unit among the pair of support units to a second support unit among the pair of support units such that the pressing member is supported by the pair of support units, wherein the first support unit includes a first support body and a first belt support part having a first belt contact surface to support an inner surface of the fixing belt, the first belt support part protruding from the first support body toward the second support unit in the width direction, the second support unit includes a second support body and a second belt support part having a second belt contact surface to support the inner surface of the fixing belt, the second belt support part protruding from the second support body toward the first support unit in the width direction, and the guide unit is to guide the rotation of the fixing belt independently of the limiting the movement of the fixing belt in the width direction by the pair of support units such that rotation of the fixing belt is not influenced by movement of the pair of support units when one or both of the first and second support units are in an inclined state.

2. The fixing device according to claim 1, wherein the pair of support units are detachably coupled to the guide unit.

3. The fixing device according to claim 1, wherein the pair of support units are to move interrelatedly with the guide unit.

4. The fixing device according to claim 1, wherein the guide unit comprises:

a unit body arranged in the fixing belt in a width direction, and a pair of rotation guide parts extending from the unit body and to guide rotation of the fixing belt at positions corresponding to respective ends of the fixing belt in the width direction.

5. The fixing device according to claim 4, wherein the pair of support units are disposed farther from a center of the width direction than the respective pair of rotation guide parts.

6. The fixing device according to claim 4, wherein the unit body is disposed in the fixing belt to allow the fixing belt to pass between the unit body and the fixing roller, and the rotation guide part extends from the unit body along the inner surface of the fixing belt.

7. The fixing device according to claim 4, wherein each of the pair of rotation guide parts comprise a plurality of rotation guide ribs formed in contact with the inner surface of the fixing belt.

8. The fixing device according to claim 7, wherein the rotation guide ribs of the plurality of rotation guide ribs are arranged at intervals decreasing as the rotation guide ribs are closer to the ends of the fixing belt in the width direction.

9. The fixing device according to claim 7, wherein the plurality of rotation guide ribs comprise first rotation guide ribs and second rotation guide ribs, the second rotation guide ribs arranged closer to width directional ends of the fixing belt than the first rotation guide ribs and having greater sizes than the first rotation guide ribs.

10. The fixing device according to claim 7, wherein the plurality of rotation guide ribs comprise a rib contact part in contact with the inner surface of the fixing belt and a rib concave part, the rib concave part more recessed than the rib contact part to be spaced apart from the inner surface of the fixing belt.

11. The fixing device according to claim 4, wherein the guide unit further comprises a belt guide part arranged between the pair of rotation guide parts and supporting the inner surface of the fixing belt.

12. The fixing device according to claim 1, wherein the fixing device further comprises a heat source disposed at the inner surface of the fixing belt adjacently to the fixing roller and to directly transfer heat to the fixing belt.

13. The fixing device according to claim 1, wherein the fixing device further comprises a bracket to limit movement of the support units, wherein the support units are mounted to seating portions formed in the guide unit, and movement of the support units in the width direction is limited by the bracket.

14. The fixing device according to claim 1, wherein the pressing member includes a first protrusion which protrudes centrally from a first end of the pressing member toward the first support unit, and a second protrusion which protrudes centrally from a second end of the pressing member toward the second support unit, the first support unit includes a first protrusion groove provided in a central portion of the first belt support part in which the first protrusion of the pressing member is inserted, and the second support unit includes a second protrusion groove provided in a central portion of the second belt support part in which the second protrusion of the pressing member is inserted.

15. The fixing device according to claim 4, wherein the unit body is disposed at one side of the inner surface of the fixing belt to allow the fixing belt to pass between the unit body and the fixing roller, and the first and second belt unit support parts correspond to the other side of the inner surface of the fixing belt.

16. An image forming apparatus comprising:

a fixing device to fix a visible image transferred to the image forming apparatus to a printing medium, wherein the fixing device comprises:

a fixing belt rotatably arranged in the fixing device;

a fixing roller disposed to have a surface face an outer surface of the fixing belt and forming a fixing nip together with the outer surface of the fixing belt;

a pair of support units having a belt limiting surface to limit movement of the fixing belt in a width direction and each of the pair of support units arranged at a respective end of the fixing belt;

a guide unit having a surface in contact with an inner surface of the fixing belt to guide rotation of the fixing belt, the guide unit comprising rotation guide parts disposed in the fixing belt at positions of the fixing belt more interior than the pair of support units; and a pressing member, having an arch-shaped cross-section, to press the guide unit toward the fixing roller and being longitudinally elongated from a first support unit among the pair of support units to a second support unit among the pair of support units such that the pressing member is supported by the pair of support units, wherein the first support unit includes a first support body and a first belt support part having a first belt contact surface to support the inner surface of the fixing belt, the first belt support part protruding from the first support body toward the second support unit in the width direction, the second support unit includes a second support body and a second belt support part having a second belt contact surface to support the inner surface of the fixing belt, the second belt support part protruding from the second support body toward the first support unit in the width direction, and the guide unit is to guide the rotation of the fixing belt independently of the limiting the movement of the fixing belt in the width direction by the pair of support units such that rotation of the fixing belt is not influenced by movement of the pair of support units when one or both of the first and second support units are in an inclined state.

17. The fixing device according to claim 16, wherein the rotation guide parts comprise a plurality of rotation guide ribs formed in contact with the inner surface of the fixing belt.

18. The fixing device according to claim 17, wherein the plurality of rotation guide ribs comprise first rotation guide ribs and second rotation guide ribs, the second rotation guide ribs arranged closer to the ends of the fixing belt in the width direction than the first rotation guide ribs and having greater sizes than the first rotation guide ribs.

19. The fixing device according to claim 17, wherein the plurality of rotation guide ribs comprise a rib contact part in contact with the inner surface of the fixing belt and a rib concave part, the rib concave part more recessed than the rib contact part to be spaced apart from the inner surface of the fixing belt.

20. An image forming apparatus comprising:

a fixing belt to rotate in a first direction and arranged in the image forming apparatus with a second direction as a width direction;

a fixing roller disposed to have a surface face an outer surface of the fixing belt and forming a fixing nip together with the outer surface of the fixing belt;

a guide unit comprising a rotation guide part having a surface in contact with an inner surface of the fixing belt to guide rotation of the fixing belt in the first direction and arranged in the fixing belt;

a pair of support units having a belt limiting surface to limit a movement of the fixing belt in the second direction and spaced apart from both ends of the fixing belt; and a pressing member, having an arch-shaped cross-section, to press the guide unit toward the fixing roller and being longitudinally elongated from a first support unit among the pair of support units to a second support unit among the pair of support units such that the pressing member is supported by the pair of support units, wherein the first support unit includes a first support body and a first belt support part having a first belt contact surface to support the inner surface of the fixing belt, the first belt support part protruding from the first support body toward the second support unit in the width direction, the second support unit includes a second support body and a second belt support part having a second belt contact surface to support the inner surface of the fixing belt, the second belt support part protruding from the second support body toward the first support unit in the width direction, and the guide unit is to guide the rotation of the fixing belt independently of the limiting the movement of the fixing belt in the width direction by the pair of support units such that rotation of the fixing belt is not influenced by movement of the pair of support units when one or both of the first and second support units are in an inclined state.

* * * * *